United States Patent [19]

Holland-Letz et al.

[11] Patent Number: 5,024,126

[45] Date of Patent: Jun. 18, 1991

[54] SLIP-RESISTANT PLASTIC SURFACE AND PROCESS FOR PRODUCING SUCH

[75] Inventors: Horst Holland-Letz; Rainer Bubel, both of Neustadt/Hessen, Fed. Rep. of Germany

[73] Assignee: Felo-Werkzeugfabrik, Fed. Rep. of Germany

[21] Appl. No.: 489,788

[22] Filed: Mar. 5, 1990

Related U.S. Application Data

[63] Continuation of Ser. No. 157,894, Feb. 19, 1988, abandoned.

[30] Foreign Application Priority Data

Feb. 19, 1987 [DE] Fed. Rep. of Germany ..... 3705298

[51] Int. Cl.[5] ..... B25G 1/01

[52] U.S. Cl. ..... 81/489; 81/900; 427/393.5; 428/143; 428/147

[58] Field of Search ..... 427/393.5; 428/147, 428/143; 4/576, 582, 583; 273/72 R, 75, 81 R; 294/15; 81/489, 900

[56] References Cited

U.S. PATENT DOCUMENTS

| | | | |
|---|---|---|---|
| 1,860,561 | 5/1932 | Warner | 81/489 |
| 2,628,172 | 2/1953 | Jenett | 427/393.5 X |
| 3,874,984 | 4/1975 | Newman | 428/147 X |
| 4,625,344 | 12/1986 | Howard | 4/582 |
| 4,659,596 | 4/1987 | Karim | 427/393.5 |

FOREIGN PATENT DOCUMENTS

| | | | |
|---|---|---|---|
| 3218899 | 5/1982 | Fed. Rep. of Germany . | |
| 3301202 | 1/1983 | Fed. Rep. of Germany . | |
| 3342266 | 11/1983 | Fed. Rep. of Germany . | |
| 48-12064 | 4/1973 | Japan | 427/393.5 |
| 48-14433 | 5/1973 | Japan | 427/393.5 |
| 48-28342 | 8/1973 | Japan | 427/393.5 |
| 49-12581 | 3/1974 | Japan | 427/393.5 |
| 52-74672 | 6/1977 | Japan | 427/393.5 |
| 7012134 | 10/1970 | Netherlands | 427/393.5 |

*Primary Examiner*—Michael Lusignan

*Attorney, Agent, or Firm*—Leydig, Voit & Mayer

[57] ABSTRACT

A process is disclosed for producing a coarse surface on a plastic article, comprising preparing a dispersion of fine crystalline material in a solution of a polymer from which the plastic article is made. The article is immersed into the dispersion, causing a partial solvation and softening of the surface layer coated by the dispersion. Upon removal of the solvent component of the dispersion from the article surface, the fine crystalline material is embedded into the surface of the article so as to create a textured surface suitable for gripping and the like.

5 Claims, No Drawings

SLIP-RESISTANT PLASTIC SURFACE AND PROCESS FOR PRODUCING SUCH

This is a continuation of copending application Ser. No. 157,894, filed on Feb. 19, 1988, now abandoned.

FIELD OF THE INVENTION

The invention concerns a method for producing coarse surfaces on components made from plastic, and particularly components made by injection molding. The invention is most applicable for plastic devices and articles for which the gripping ability or slip resistance is to be improved, as, for example, tool handles, stairway covers, etc.

BACKGROUND OF THE INVENTION

It is known to produce coarse matte surfaces on injection molded components by texturing the injection molds, as, for example, by electronic discharge machining or photo-chemical etching. However, this process is suitable only for relatively thin-walled injection-molded components which cool in the mold to such an extent that the temperature is below that at which the material becomes plasticly deformable. Thicker-walled components, are often still so hot during removal from the mold that the heat remaining in the surrounding portions of the mold cause any existing texture to disappear. Thus, the desired effects of improved gripping ability and slip resistance are not attained. In such cases, the surface may be highly roughed by blasting it with a slightly abrasive medium, such as nut-shell fines. The disadvantage of such blasting treatment is that small particles are torn out of the surface of the plastic component, and the dust caused therefrom must be removed. Another disadvantage is that the color of the surface is changed somewhat.

OBJECTS AND SUMMARY OF THE INVENTION

It is an object of this invention to produce plastic articles with coarse surfaces which articles have a uniform surface, have a controllable degree of coarseness, do not require further finishing, and do not exhibit color changes.

According to the invention, polymer material from which the particular article is made is dissolved in a suitable solvent, whereby the ratio of solvent to polymer is approximately in the range of 7 to 1 to 15 to 1. For example, if the article is made from polycarbonate, the solvent, as is well known in the art, may be dimethylacetamide dimethylformamide, or dimethylsulfoxide, among others. Fine crystalline material is stirred into the solution, in the approximate range of about 7 to 1 to 20 to 1 of solution to crystalline material, thereby forming a dispersion. The relative proportions of the components depend upon the specific gravity of the polymer, the crystalline material and the desired degree of coarseness. The article is then immersed into the dispersion, causing a partial solvation and softening of the surface layer of the article. Upon removal of the article from the dispersion bath, a film of the dispersion remains intricately bonded to the partially solvated surface layer of the plastic article.

The solvent is then removed from the layer coating the workpiece by, for example, evaporation and/or washing, leaving behind a layer of polymer in which the crystalline material is finely distributed and firmly anchored.

By selecting the size of the crystalline particles and its concentration, the degree of coarseness may be precisely controlled.

The process of this invention permits a highly uniform texturing of the entire surface of a workpiece. Because the crystalline material is firmly embedded in the polymer, the coarse texture is maintained even after prolonged use. This is of particular importance in tool handles and grips, for example. Any color changes are minimal and controllable by adjusting the composition of the dispersion solution.

I claim:

1. A process for producing a slip-resistant surface on a plastic tool handle for ease in gripping, said process comprising the steps of preparing a dispersion of fine crystalline material in a solution of a polymer from which said plastic handle is made, coating the surface of said plastic handle with said dispersion, and removing the solvent component of said dispersion from said surface such that said fine crystalline material is embedded into said surface, thereby making said surface slip-resistant.

2. The process of claim 1 wherein the ratio of solvent to polymer in said solution is in the approximate range of about 7 to 1 to 15 to 1.

3. The process of claim 1 including the step of partially solvating and softening the surface of said plastic tool handle prior to removing the solvent component of said dispersion.

4. The process of claim 1 wherein the ratio of said solution to said fine crystalline material is in the approximate range of about 7 to 1 to 20 to 1.

5. A tool having a plastic handle with a slip-resistant gripping surface in which said surface is produced by coating the handle of said tool with a film of a solution of the polymer from which said handle is made, in which solution crystalline material has been dispersed and permitting the solvent in said film to evaporate after it has partially solvated and softened the surface of said plastic handle.

* * * * *